US008113674B2

(12) United States Patent
Ridgel

(10) Patent No.: US 8,113,674 B2
(45) Date of Patent: Feb. 14, 2012

(54) STORM LIGHT

(76) Inventor: Dwain Keith Ridgel, Jacksonville, FL (US)

( * ) Notice: Subject to any disclaimer, the term of this patent is extended or adjusted under 35 U.S.C. 154(b) by 309 days.

(21) Appl. No.: 12/427,884

(22) Filed: Apr. 22, 2009

(65) Prior Publication Data

US 2010/0271801 A1 Oct. 28, 2010

(51) Int. Cl.
*F21V 19/04* (2006.01)
*F21L 4/00* (2006.01)

(52) U.S. Cl. ..... 362/20; 362/183; 362/276; 362/85

(58) Field of Classification Search ..... 362/20, 362/183, 85, 276, 253, 411, 394, 295, 802, 362/157
See application file for complete search history.

(56) References Cited

U.S. PATENT DOCUMENTS 3,601,595 A * 8/1971 Kivela ..... 362/190
5,684,378 A * 11/1997 Furth et al. ..... 362/183
5,713,655 A * 2/1998 Blackman ..... 362/20
2010/0039792 A1* 2/2010 Meyers et al. ..... 362/20

* cited by examiner

*Primary Examiner* — Bao Q Truong
(74) *Attorney, Agent, or Firm* — Dale J. Ream

(57) ABSTRACT

A storm light includes a housing having walls, a light positioned on the housing, and a battery electrically connected to the light. A control unit situated in the housing is electrically connected to the light and battery, the control unit having programming corresponding to ON, OFF, and AUTOMATIC modes. A mode selection switch is positioned on the housing and electrically connected to the control unit, the mode switch being movable between positions corresponding to respective modes. An electrical plug is mounted to the housing and electrically connected to the control unit. The control unit includes programming initiated when the mode switch is at the ON position that causes the light to be energized by AC power if the plug is connected to AC power and the AC power is available and that causes the light to be energized by the battery if AC power is unavailable.

6 Claims, 5 Drawing Sheets

STORM LIGHT

BACKGROUND OF THE INVENTION

This invention relates generally to a light device and, more particularly, to an emergency storm light for traditional use as a flashlight and for emergency lighting when an electrical power outage is experienced.

There are many uses for a small, portable light. Flashlights are useful in that they may be carried by a user while walking or for illuminating a location not accessible to traditional lighting. So called "night lights" are useful to provide small amounts of lighting either to illuminate a darkened walkway or just to provide emotional security to a child. Although these devices are assumably effective for their intended purposes, there are shortcomings as well, such as electrical power outages in the case of night lights and the short duration of batteries in the case of flashlights.

Therefore, it would be desirable to have a storm light having multiple modes for use as a flashlight, a night light, and an emergency storm light when electrical power is interrupted. Further, it would be desirable to have a storm light that is rechargeable when plugged into a traditional electrical outlet and includes a timer so that the light may be deactivated after a predetermined time. In addition, it would be desirable to have a storm light having a belt clip for hands free usage.

SUMMARY OF THE INVENTION

A storm light according to the present invention includes a housing having a plurality of walls defining an interior space, a light positioned on the housing for transmitting light when energized, and a battery positioned in the interior space and electrically connected to the light. A control unit is situated in the interior space and electrically connected to the light and the battery, the control unit having programming corresponding to ON, OFF, and AUTOMATIC modes of operation. A mode selection switch is positioned on the housing and electrically connected to the control unit, the mode selection switch being movable between positions corresponding to respective modes. An electrical plug is mounted to the housing that is electrically connected to the control unit and configured to connect to AC power. The control unit includes programming initiated when the mode selection switch is at the ON position that causes the light to be energized by AC power if the plug is connected to the AC power and the AC power is available and that causes the light to be energized by the battery if the AC power is unavailable.

Therefore, a general object of this invention is to provide a storm light having multiple modes to enable selective usage as a flashlight, night light, or battery powered emergency storm light.

Another object of this invention is to provide a storm light, as aforesaid, that includes a battery that is rechargeable when the device is plugged into an electrical receptacle or car charger.

Still another object of this invention is to provide a storm light, as aforesaid, that is capable of hands free use.

Yet another object of this invention is to provide a storm light, as aforesaid, that promotes electricity conservation in that it includes a timer for self-deactivation.

A further object of this invention is to provide a storm light, as aforesaid, in which a nightlight mode may include a dimmer for selective illumination.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
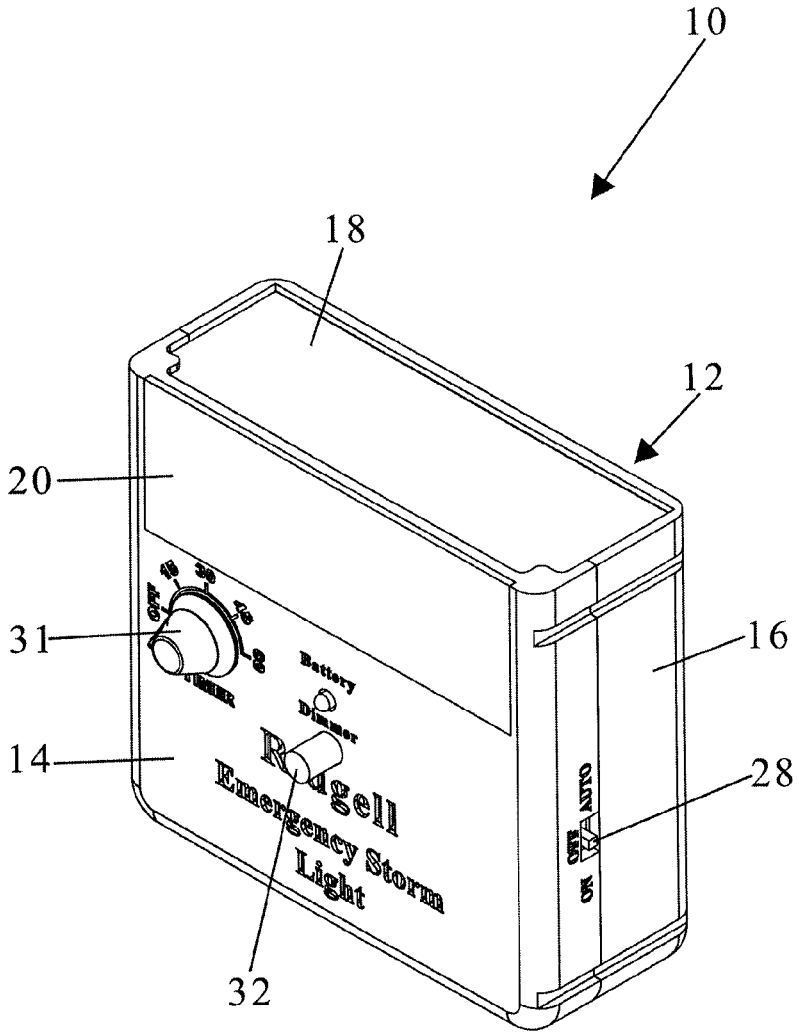
FIG. 1 is a perspective view of a storm light according to a preferred embodiment of the present invention.

A storm light according to a preferred embodiment of the present invention will now be described with reference to FIGS. 1 to 6 of the accompanying drawings. More particularly, the storm light 10 includes a housing 12 having a front wall 14, a rear wall, opposed side walls 16, along with a top 18 and bottom that define an interior space for containing electronic components to be described below.

Figure 3:
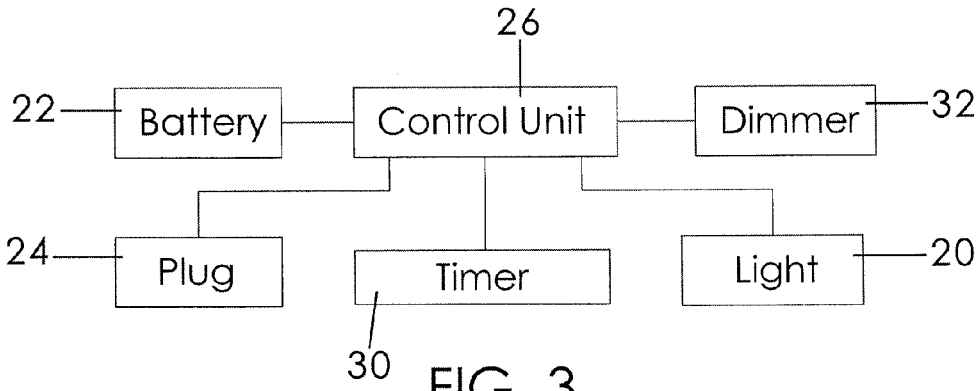
FIG. 3 is a block diagram illustrating the electrical components of the storm light.

A light 20 is positioned within the interior space of the housing 12 for transmitting light when energized (FIG. 3). Preferably, the light 20 is an LED although an incandescent light or other suitable light would also work. The housing 12 may include a transparent window in a front wall 14 through which the light emissions may pass (FIG. 1). It is also understood that the top 18 may have a transparent construction through which light may pass. A removable cover 19 may be attachable to the housing 12 for covering the top 18, such as when the device is not being used as a flashlight.

Figure 2A:
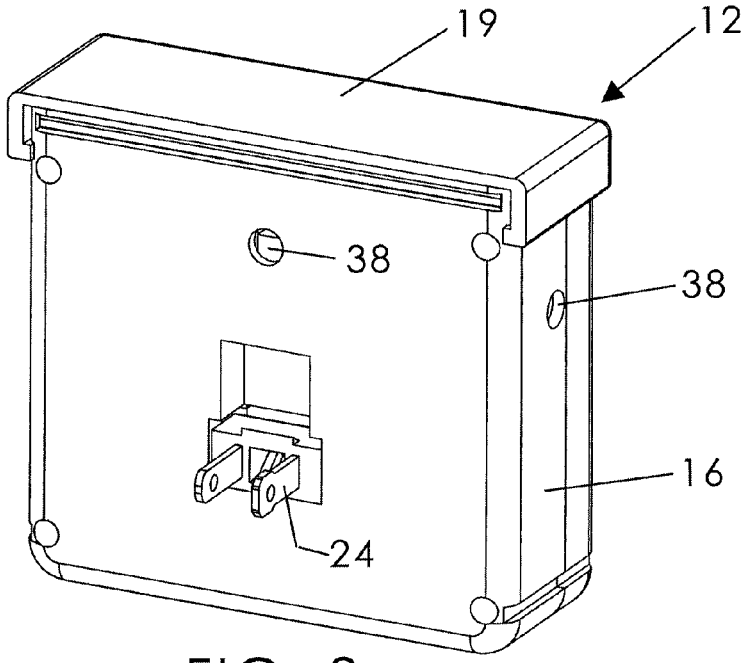
FIG. 2*a* is a rear perspective view of the storm light as in FIG. 1 with an electrical plug in an extended configuration.
Figure 2B:
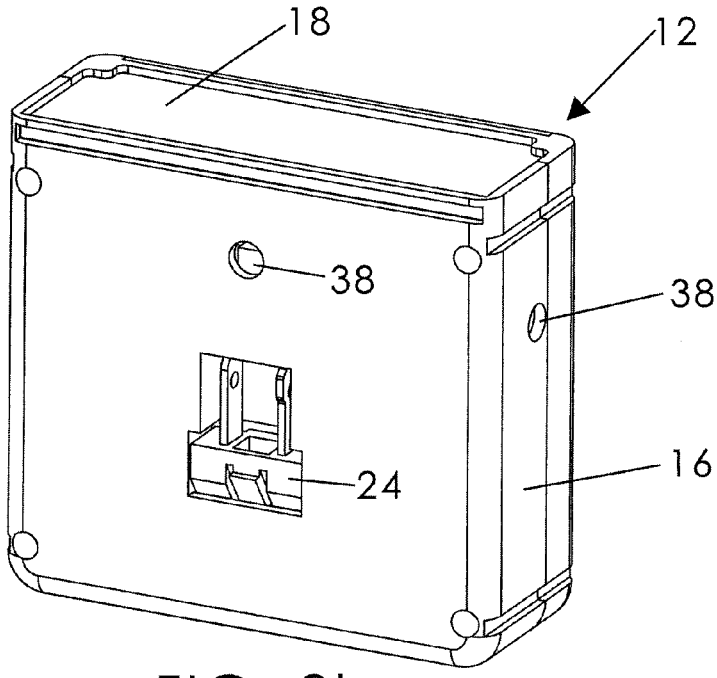
FIG. 2*b* is a rear perspective view of the storm light as in FIG. 1 with an electrical plug in a retracted configuration.

The light 20 may be energized by either a battery 22 or by traditional AC current. The battery 22 is positioned within the interior space of the housing 12 and is preferably rechargeable. The storm light 10 includes an electrical plug 24 that is positioned on a rear wall 15 thereof and is electrically connected to the light 20 for operation as discussed in more detail later. The electrical plug is movable between an extended/use configuration (FIG. 2*a*) and a retracted/storage configuration (FIG. 2*b*).

A control unit 26 is also situated in the interior space of the housing 12 that is electrically connected to the battery 22, light 20, and other electrical components to be discussed below. A mode selector switch 28 is positioned on the front wall 14 of the housing and is movable between at least positions corresponding to "ON," "OFF," and "AUTO" modes of operation, each of these modes corresponding to respective programming in the control unit, the control unit 26 being a processor or equivalent circuitry. The programming relative to the aforementioned modes is illustrated in the flow chart of FIG. 4.

The control unit 26 includes programming that is immediately initiated when the mode selector switch 28 is positioned at the "ON" configuration 50, the programming causing the light 20 to be energized by AC current, as indicated by numeral 58, if the plug 24 is engaged with an AC receptacle and AC current is currently available 52. The programming, however, causes the light 20 to be energized by allowing current to flow from the battery 22 to the light if either the plug 24 is not engaged with an AC receptacle or if AC power is simply not available 54 to the receptacle. In other words, if the control unit 26 does not detect that any AC power is available, as indicated by reference numeral 54, the control unit 26 connects the battery 22, as shown at 56 to energize the light 20, as indicated at 58.

The control unit 26 includes programming relative to an automatic mode. If the mode selector switch 28 is positioned in the AUTO mode 60, the control unit 26 then checks to see if AC power is available 62, such as by electrically signaling or polling the plug 24. If AC power is available, the control unit 26 simply continues to monitor this status. If, however, AC power is not available—which may be indicative of a power outage—the control unit 26 enables the battery 22 to deliver current to the light 20 as indicated at 64 and 66, respectively.

Figure 4:
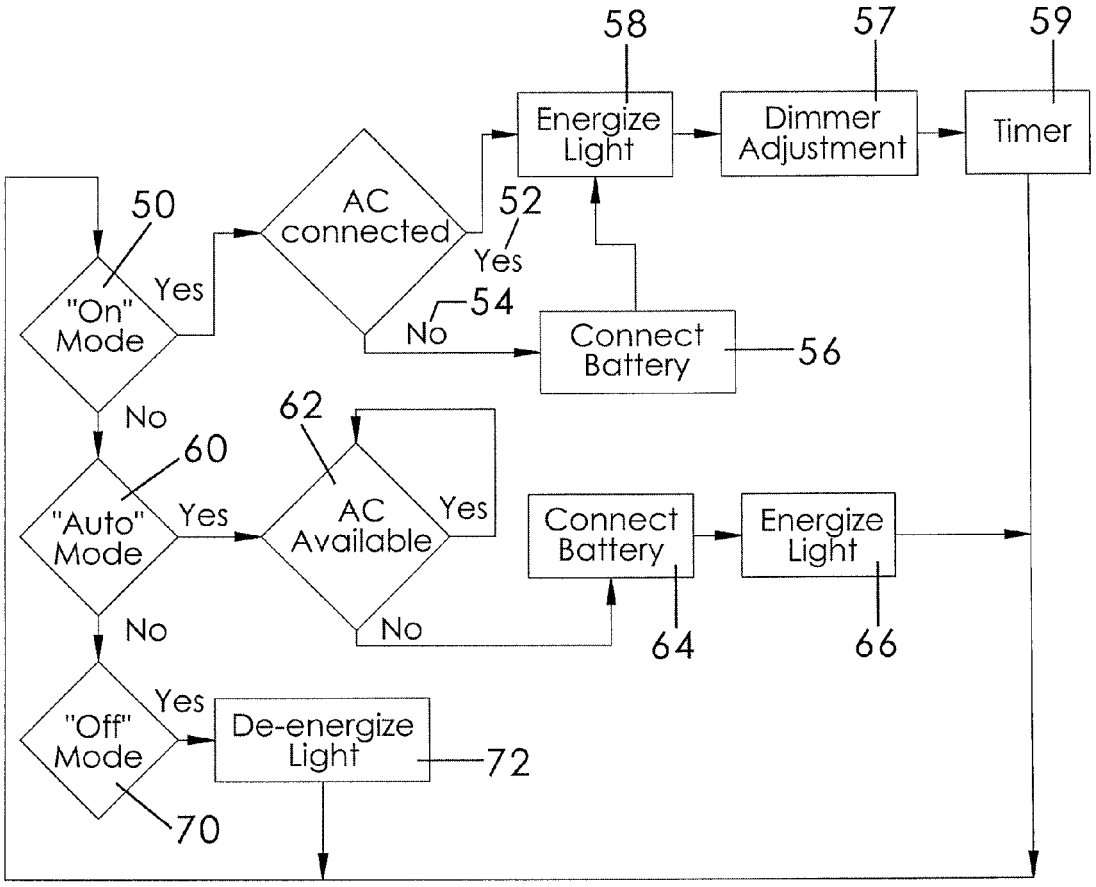
FIG. 4 is a flow chart illustrating the logic performed by the control unit of FIG. 3.
Figure 5:
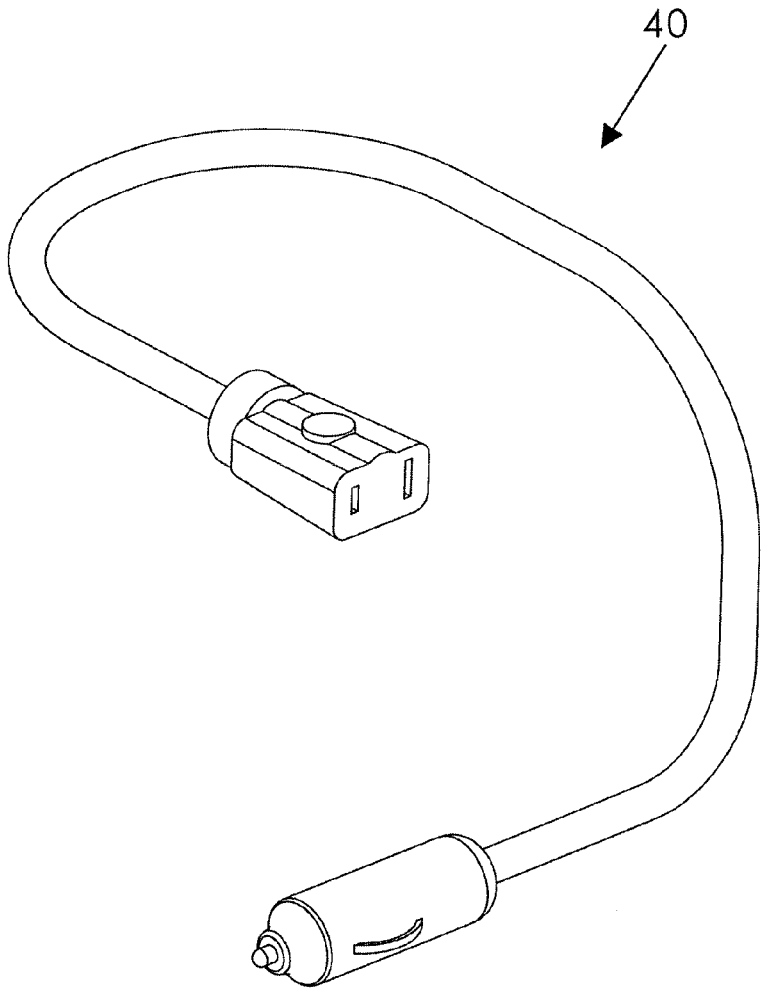
FIG. 5 is a perspective view of a car charger unit for use with the storm light.

The control unit 26 also includes programming that causes the light 20 to be deactivated or de-energized when the mode selector switch 28 is positioned at the OFF configuration. As shown in FIG. 4, if the selector switch 28 is at the OFF position 70, the light 20 is de-energized 72, such as by blocking current from the plug 24 and the battery 22.

As shown in FIG. 3, the control unit 26 further includes a timer circuit 30, or other electrical component referred to herein simply as a timer, that is positioned within the interior space of the housing 12 and that is electrically connected to the control unit 26. A timer selection switch 31 is positioned on an outer wall—preferably the front wall 14—of the housing that is movable between predetermined positioned and is electrically connected to the control unit 26 such that a user may input a desired time for the timer to operate (FIG. 1). The control unit 26 includes programming for de-energizing the light 20 upon expiration of the selected amount of time. In other words, if the light has been energized in the "ON" mode, the timer may be set to de-energize the light 20 after an input amount of time, such as to not permit the light 20 from being energized all night, for example. In the ON mode, a user may select a timer setting so as to actuate operation of the timer, as indicated at block 57 in FIG. 4.

The storm light 10 may also include a dimmer selection switch 32 positioned on an outer wall and electrically connected to the control unit 26 (FIG. 1). Preferably, the dimmer selection switch 32 is a radial knob although other selector switches may also work. The dimmer selection switch 32 enables a selected amount of current to be delivered to the light 20, thus affecting the brightness of the light 20. In this way, the storm light 10 may be used as a night light. The dimmer selection switch 32 may be adjusted 59 in the ON mode of operation.

Figure 6:
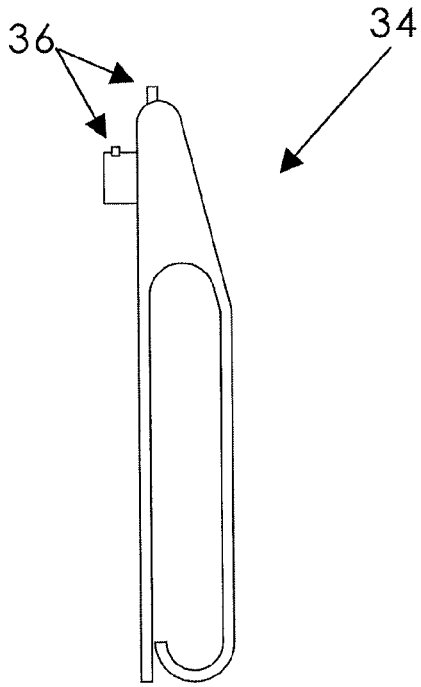
FIG. 6 is a perspective view of a belt clip component of the storm light.

The storm light 10 may further include a belt clip 34 (FIG. 6). The belt clip 34 includes fasteners 36 that are complementary to respective side and rear wall apertures 38 of the housing 12 so that belt clip 34 may be removably coupled to a side of the housing 12 when not in use and removably coupled to the rear wall of the housing 12 for use. When coupled to the rear wall, the clip 34 may be coupled to a user's belt or pants to thus give the storm light 10 hands free operability.

Still further, the storm light 10 may include a car charger 40 that enables the battery 22 to be recharged. The car charger 40 includes one end configured to engage the plug 24 of the storm light 10 and an opposed end configured to engage a vehicle's electrical adapter, such as a cigarette lighter.

In use, the storm light 10 may be used as a flashlight, night light, or as an emergency light in case of an electrical power outage. More particularly, the storm light 10 may be plugged into a traditional AC electrical receptacle. In the "ON" mode setting and with AC power being available to the receptacle, the light 20 is energized by the AC power. If no AC power is available (such as if the storm light 10 is not plugged in or in case of a power outage), the light 20 is energized by current from the battery 22. In the "on" mode, the timer 30 may be set such that the light 20 is deactivated after a user-set amount of time and the dimmer 32 may also be used to control light intensity (e.g. use as a night light). In the "AUTO" mode, the control unit 26 repeatedly monitors if AC power is available and takes no action so long as AC power is maintained. This is the case where the storm light 10 is plugged in and available in case of a power outage. If, in fact, the AC power is interrupted, the control unit 26 causes the battery 22 to deliver current to the light 20 and the light 20 is energized.

It is understood that while certain forms of this invention have been illustrated and described, it is not limited thereto except insofar as such limitations are included in the following claims and allowable functional equivalents thereof.

The invention claimed is:

1. A storm light, comprising:

a housing having a front wall, a rear wall, opposed side walls, a top wall, and a bottom wall, that together define an interior space;

a light positioned within said interior space for transmitting light emissions when energized;

wherein:

said front wall includes a transparent window through which light emissions pass when said light is energized;

said top includes a transparent construction through which light emissions pass when said light is energized;

a battery positioned in said interior space and electrically connected to said light;

a control unit situated in said interior space and electrically connected to said light and said battery, said control unit having programming corresponding to ON, OFF, and AUTOMATIC modes of operation;

a mode selection switch on said housing and electrically connected to said control unit, said mode selection switch being movable between positions corresponding to respective modes;

an electrical plug mounted to said housing that is electrically connected to said control unit and configured to be removably connected to an electrical receptacle and convey AC power therefrom;

programming in said control unit initiated when said mode selection switch is at said ON position that when executed energizes said light by AC power if said electrical plug is connected to said AC power and said AC power is available and that energizes said light by said battery if said AC power is unavailable a timer positioned in said interior space of said housing and electrically connected to said control unit and said light;

a timer selection switch positioned on an outer wall of said housing and electrically connected to said control unit by which a selected amount of time is input by a user;

programming in said control unit that when executed by said control unit determines if said mode selection switch is at said ON position and, if so, causes said light to be de-energized after said selected amount of time has expired;

programming in said control unit that when executed by said control unit that automatically causes said light to be energized by said battery if said mode selection switch is at said AUTO position and if said plug is connected to said AC power but said AC power is unavailable; and programming in said control unit that when executed causes said light to be de-energized when said mode selection switch is at said OFF position.

2. The storm light as in claim 1, further comprising a dimmer selection switch positioned on an outer wall of said housing and electrically connected to said control unit by which an amount of current available to said light is controlled by a user.

3. The storm light as in claim 1, wherein said plug is movable between an extended configuration and a retracted configuration.

4. The storm light as in claim 1 further comprising a belt clip removably coupled to said housing.

5. The storm light as in claim 1 further comprising a car charger having a first end configured to interface with said electrical plug and a second end adapted to interface with an automobile electric receptacle.

6. The storm light as in claim 1 further comprising a cover removably coupled to said top wall of said housing, said cover having a configuration that selectively covers said top wall so as to block light emissions from passing through said top wall when said light is energized.

* * * * *